US011154152B2

(12) United States Patent
Hammar

(10) Patent No.: US 11,154,152 B2
(45) Date of Patent: Oct. 26, 2021

(54) MAILBOX SUPPORT SYSTEM

(71) Applicant: Jerry R. Hammar, Hudson, OH (US)

(72) Inventor: Jerry R. Hammar, Hudson, OH (US)

( * ) Notice: Subject to any disclaimer, the term of this patent is extended or adjusted under 35 U.S.C. 154(b) by 143 days.

(21) Appl. No.: 16/777,136

(22) Filed: Jan. 30, 2020

(65) Prior Publication Data

US 2020/0245799 A1 Aug. 6, 2020

Related U.S. Application Data

(60) Provisional application No. 62/799,820, filed on Feb. 1, 2019.

(51) Int. Cl.
*A47G 29/12* (2006.01)

(52) U.S. Cl.
CPC ..... *A47G 29/1216* (2013.01)

(58) Field of Classification Search
CPC ... A47G 29/1216; A47G 29/1209; A45F 3/44; E04H 12/2215; E04H 12/223
USPC ..... 232/39; 248/156, 530, 545; 52/155
See application file for complete search history.

(56) References Cited

U.S. PATENT DOCUMENTS 1,010,759 A 12/1911 Henning et al.
2,079,510 A * 5/1937 King ..... A47G 29/1216 248/145
3,193,059 A 7/1965 Wallerstein, Jr.
4,172,579 A 10/1979 Steinman
4,429,849 A * 2/1984 Maier ..... E04G 21/1833 248/156
4,479,636 A 10/1984 King
4,723,879 A 8/1988 Wasicek et al.
4,792,088 A 12/1988 Bonnell
4,793,370 A 12/1988 Perez et al.
4,930,271 A 6/1990 Pizzichemi
4,951,904 A * 8/1990 Obenshain ..... A47G 29/1216 232/39
5,060,435 A 10/1991 Bogdanow
5,123,623 A * 6/1992 McNamara ..... E04H 12/2253 248/156
5,192,055 A 3/1993 Griggs et al.
5,244,172 A 9/1993 Allega
5,307,598 A * 5/1994 West ..... A47G 29/1216 232/39
5,713,514 A * 2/1998 Eck ..... A47G 29/1216 232/17
5,820,470 A 10/1998 Saunders
(Continued)

*Primary Examiner* — William L Miller
(74) *Attorney, Agent, or Firm* — Brian Harrod; George W. Moxon, II

(57) ABSTRACT

A mailbox support system comprising a triangular frame, comprising a generally vertical side having an outer side surface, a ground side having a bottom surface and lower guide hole, and an angled side having a top surface and an upper guide hole; and an angled anchoring stake, having a short end and a long end; wherein the long end of said anchoring stake passes through said upper guide hole in said angled side and said lower guide hole in said ground side, such that at least one third of its length extends beyond the bottom surface of said bottom side, and said short end lies parallel to and flush against the top surface of said angled side; wherein said upper guide hole and said lower guide hole cooperate to guide the anchoring stake through said frame at an angle between 50° and 70° from vertical.

11 Claims, 3 Drawing Sheets

(56) References Cited

U.S. PATENT DOCUMENTS 6,807,782 B2 10/2004 Forman et al.
6,824,113 B1 11/2004 Gee et al.
6,962,460 B1 11/2005 Pratt
6,974,073 B1 12/2005 Snyder
7,044,449 B2 * 5/2006 Wink ..... E04H 12/2215 248/156
7,080,773 B1 7/2006 Tepley
7,311,291 B2 12/2007 Robinson
7,364,066 B1 4/2008 Wilson
7,438,273 B2 10/2008 Tota
7,559,457 B2 7/2009 Webber
8,061,089 B2 11/2011 Russell
8,114,510 B2 2/2012 Dai et al.
8,794,505 B1 8/2014 Richardson
8,893,444 B2 11/2014 Richardson
8,925,225 B2 1/2015 Fiore
9,482,023 B1 11/2016 Carmody
9,980,593 B2 * 5/2018 Pajonas ..... A47G 29/1209
2006/0186188 A1 8/2006 Belanger
2008/0314967 A1 12/2008 Black
2009/0278001 A1 * 11/2009 Sherburne ..... A47G 29/1216 248/146
2010/0000164 A1 * 1/2010 Russell ..... E04H 12/2215 52/165
2010/0243977 A1 9/2010 Middlebrook, Jr.
2011/0068236 A1 3/2011 Austin, III et al.
2011/0253877 A1 * 10/2011 McCown ..... E04H 12/2215 248/548
2014/0231613 A1 8/2014 Basconi
2015/0108295 A1 * 4/2015 Brooks ..... F16M 11/242 248/156
2015/0159337 A1 * 6/2015 Kellner ..... E04H 12/2284 248/156
2015/0224383 A1 * 8/2015 Adema ..... E04H 12/2253 473/435
2016/0073812 A1 * 3/2016 Pickens ..... A47G 29/1216 232/38

* cited by examiner

MAILBOX SUPPORT SYSTEM

BACKGROUND OF THE INVENTION

A snowplow typically clears a roadway by using a large blade to push snow and ice towards the side of the roadway. Because of their positioning on the sides of roadways, mailboxes are frequently hit by the snow, ice, and other debris when a snowplow passes. This debris, which frequently includes rocks and sand, in addition to the snow and ice, can easily damage or destroy the mailbox.

Roadside mailboxes are commonplace in the United States, and protecting Such mailboxes from damage has long been a problem. Traditional roadside mailboxes offer no protection at all from snow and/or debris thrown by snowplows. While certain remedies have been attempted, they typically require one to purchase a specially designed mailbox, or to fortify a traditional mailbox with brick or other improvements which may be costly and otherwise undesirable.

Information relevant to attempts to address this problem can be found in, for example U.S. Pat. No. 6,962,460 to Pratt; U.S. Pat. No. 7,364,066 to Wilson; and U.S. Pat. No. 7,080,773 to Tepley; as well as in US Patent Publication No. 2008/0314967 to Black. However, these references utilize costly protective mechanisms, require the use of specialized mailboxes, require the use of permanent fixtures, and/or do not sufficiently protect a mailbox.

As a result, there is a need for apparatus for protecting conventional mailboxes that are inexpensive to manufacture, effective, and easy to set up. In addition, these apparatus should also be easy to remove and store during those seasons when they are not needed.

SUMMARY OF THE INVENTION

The invention relates to a mailbox support system comprising a triangular frame, comprising a generally vertical side having an outer side surface, a ground side having a bottom surface and lower guide hole, and an angled side having a top surface and an upper guide hole; and an angled anchoring stake, having a short end and a long end; wherein the long end of said anchoring stake passes through said upper guide hole in said angled side and said lower guide hole in said ground side, such that at least one third of its length extends beyond the bottom surface of said bottom side, and said short end lies parallel to and flush against the top surface of said angled side; wherein said upper guide hole and said lower guide hole cooperate to guide the anchoring stake through said frame at an angle between 50° and 70° from vertical.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DETAILED DESCRIPTION OF THE INVENTION

Figure 1:
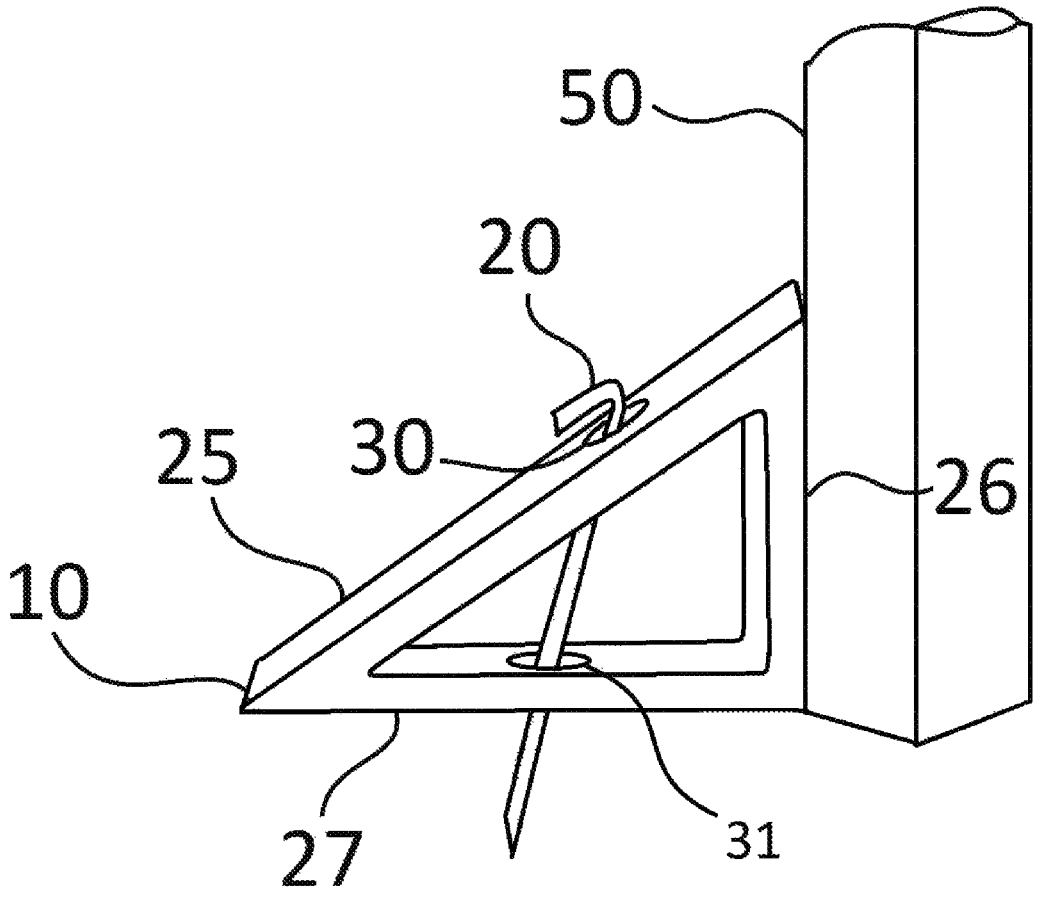
FIG. 1 is a side perspective view of the present invention installed to a post.
Figure 2:
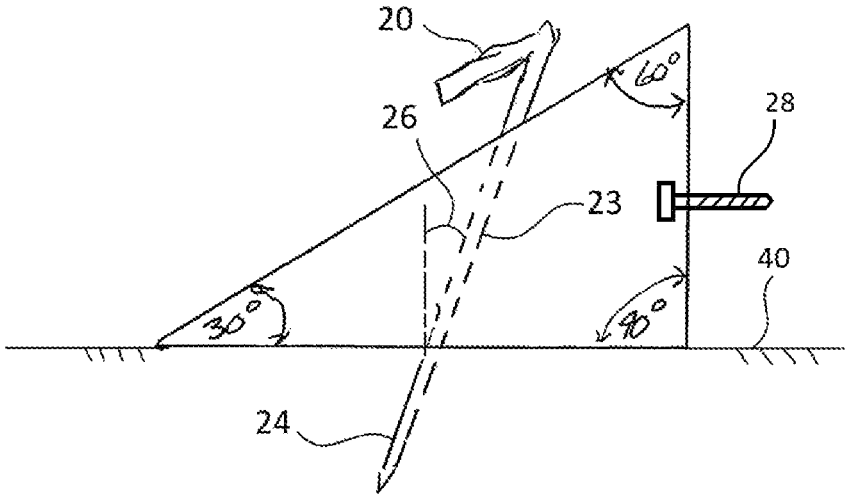
FIG. 2 is a side view of the frame and anchor.
Figure 3:
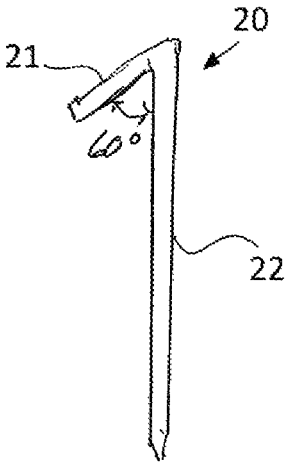
FIG. 3 is a side view of anchoring stake.

The invention relates to a system for supporting a mailbox post. The mailbox support system is made up of a support frame and an anchoring stake. Combined as a unit, they are an accessory to the mailbox. This unit is designed to prevent damage from the effects of the street snowplow removing snow from the streets. The snow thrown by the plow against the mailbox can and does drive the mailbox from vertical to a bent angle. This unit can withstand the forces and maintain a vertical position eliminating the need to repair and re-straighten it later. It also allows the mailbox to stay within the standards of the US Postal Service (USPS).

A secondary effect is to provide an aesthetic view for the mailbox. The support can be installed alone or in pairs. Using two supports, one can be installed on each side of the mailbox post to give a balanced look.

As shown in the figures, the mailbox support system comprises a triangular frame 10. The frame 10 abuts the mailbox support post 50, lending additional support to resist lateral force caused when the mailbox and post are struck by snow and debris from a passing snowplow.

An anchor support slot 30 is located on the slanted side 25 that goes thought the material at a 60° angle from vertical 26. The device is solid with rounded corners, but sharp corners could be used as well. Ribbing could be incorporated to increase structural strength (See FIG. 4, discussed below). This allows for easy installation and removal as needed.

The dimensions of the support frame form a right triangle, with an angled face 25 (the hypotenuse), a bottom side 27 that rests on the ground 40, and a vertical side 26 that abuts the mailbox post 50. The exact angles of the corners are not critical, but generally form a 30-60-90 right triangle. Any angles up to a 45-45-90 right triangle could be used, but 30-60-90 is preferred. The width of the unit is 3.5" to 4.0". The vertical axis is in the range of 14" to 16". The horizontal axis is 16" to 18". The angled length is 21" to 24". ¾" anchor support holes start at the top hole 30 extend completely through the shield 10 at a 60 degree angle from vertical 26 to a bottom support hole 31. The location of the hole 30 is between 9" to 12" from the vertical side 26.

A generally L-shaped, angled reinforcing anchor/stake 20 extends through the support frame structure and into the ground 40 to anchor the device in place against the mailbox post 50. The anchor stake 20 can be made from any strong material, including, but not limited to, rebar, galvanized steel and aluminum. The angle of the stake is at 60° with 4" to 5" L-shape at the shorter end 21 and 16" to 18" L-shape on the long end 22. The length of the long end 22 can be longer than 18" to give additional support, but 18" is sufficient in most cases. When in use, the anchoring stake 20 has a ground portion 24 that extends beyond the bottom surface of the bottom leg 27 and is approximately ⅓ or more of the total length of the long end 22 of the stake, which is embedded into the ground or soil 40, a middle portion 23 that extends through the angled side 25 and the bottom side 27, i.e. the length of the frame 10. The upper short L-shaped arm 22 is flush with the sloped face 25 of the frame 10. This is designed to withstand forces of up to 150 lbs. A typical snowplow throws the snow at a force of 75 to 100 lbs.

An alternate embodiment comprises a mailbox post with the support molded as a single unit. This eliminates the separate packaging and installation, and allows for the sale a complete all season unit.

The exact composition of the support frame is not critical. It could be manufactured using polypropylene or polyethylene using rotational or injection molding. Other available other materials include wood, aluminum, and other low temperature plastics such as Estane. Wood would be assembled with 4"×4" treated wood, cut to appropriate angles and lengths and then secured by countersunk SS wood screws. Aluminum would be assembled using a MIG or TIG welder.

As most mailboxes are made in polypropylene (PP) and come in three colors, the support could be tinted to match the mailbox colors commonly offered. Available colors are typically black, light brown and dark green. However, the snowplow shield can be manufactured in any color.

Figure 4:
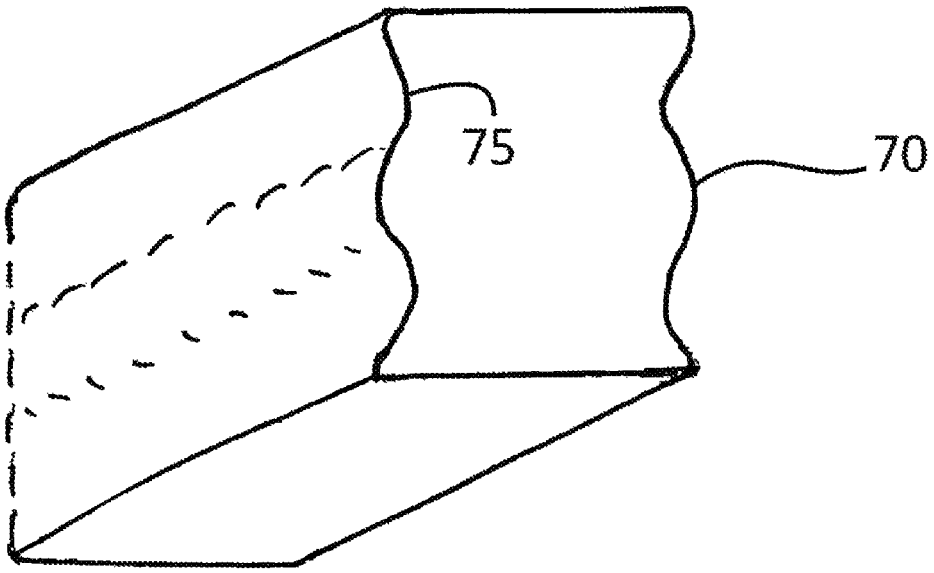
FIG. 4 is a perspective cross-sectional view of a member.

The design could also allow for some side ribs to increase structural integrity as shown in FIG. 4. FIG. 4 shows a member, which can be any of the members 25, 26, 27. The member can have one or more side rib(s) 70 molded into the piece, with a corresponding void or indentation 75. The rib 70 and indentation 75 gives strength to the member and makes it easier for the user to grip.

During installation, the user aligns the support system on the left side (as viewed from the street) of the mailbox abutting the post. The user drives the anchoring stake into the open slot on the angled face until it is flush with the angled side. A second unit may be installed on the right side of the post to balance and enhance the look.

The support system can include an optional screw or bolt (secondary fastener) 28. This fastener 28 is screwed into the vertical mailbox post though a pre-drilled hole provided on the vertical side of the frame 26 thus incorporating a second manner of anchoring and securement. Any such fastener known in the art can be used, but the preferred bolt is a ⅜×6" stainless steel lag screw. The pre-drilled hole is located on the midpoint of the vertical leg of the shield. This option can provide addition support to resist the vertical forces from the snowplow effects.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated.

What is claimed is:

1. A mailbox support system comprising:

a triangular frame, comprising a generally vertical side having an outer side surface, a ground side having a bottom surface and lower guide hole, and an angled side having a top surface and an upper guide hole; and an angled anchoring stake, having a short end and a long end;

wherein the long end of said anchoring stake passes through said upper guide hole in said angled side and said lower guide hole in said ground side, such that at least one third of its length extends beyond the bottom surface of said bottom side, and said short end lies parallel to and flush against the top surface of said angled side;

wherein said upper guide hole and said lower guide hole cooperate to guide the anchoring stake through said frame at an angle between 50° and 70° from vertical.

2. The mailbox support system of claim 1 wherein when in use, said frame can be deployed to abut a vertical post whereby the outer side surface of said vertical side contacts said post, said bottom surface contacts a ground surface, and said anchoring stake extends into said ground surface, whereby the angle of the anchor exerts a supporting force on the post to increase resistance to deflection.

3. The mailbox support system of claim 1, wherein said triangular frame is a right triangle with the angled side the hypotenuse.

4. The mailbox support system of claim 1, wherein said triangular frame is a 30-60-90 right triangle.

5. The mailbox support system of claim 1, wherein said triangular frame is a 45-45-90 right triangle.

6. The mailbox support system of claim 1, wherein said anchoring stake has an angle between said short end and said long end of between 50° to 70°.

7. The mailbox support system of claim 1, wherein said anchoring stake is angled at 60° from said vertical.

8. The mailbox support system of claim 1, wherein said triangular frame is installed in pairs.

9. The mailbox support system of claim 1, further comprising a secondary fastener that passes through said vertical side and extends beyond said side surface, and wherein when in use, said secondary fastener embeds in a mailbox support post and joins said vertical side with said mailbox support post.

10. The mailbox support system of claim 9, wherein said secondary fastener is a lag screw.

11. The mailbox support system of claim 9, wherein said secondary fastener is a ⅜×6 inch stainless steel lag screw.

* * * * *